United States Patent [19]

Mazeran

[11] Patent Number: 4,940,071

[45] Date of Patent: Jul. 10, 1990

[54] METHOD AND DEVICE FOR FABRICATING MOULDS FROM GRANULAR MATERIAL

[76] Inventor: Jean-Jacques Mazeran, F-51000, Chalon sur Marne, France

[21] Appl. No.: 350,734

[22] PCT Filed: Jul. 20, 1988

[86] PCT No.: PCT/FR88/00377

§ 371 Date: Mar. 6, 1989

§ 102(e) Date: Mar. 6, 1989

[87] PCT Pub. No.: WO89/00467

PCT Pub. Date: Jan. 26, 1989

[30] Foreign Application Priority Data

Jul. 22, 1987 [FR] France ..... 87 10514

[51] Int. Cl.[5] ..... B22C 9/02; B22C 21/02

[52] U.S. Cl. ..... 164/7.2; 164/160.2

[58] Field of Search ..... 164/7.1, 7.2, 160.1, 164/160.2

[56] References Cited

FOREIGN PATENT DOCUMENTS

| | | | |
|---|---|---|---|
| 2305229 | 8/1973 | Fed. Rep. of Germany . | |
| 2407878 | 5/1975 | Fed. Rep. of Germany . | |
| 3320881 | 12/1984 | Fed. Rep. of Germany . | |
| 2156138 | 5/1973 | France . | |
| 2307596 | 11/1976 | France . | |
| 51-11018 | 4/1976 | Japan | 164/160.2 |
| 55-70442 | 5/1980 | Japan | 164/7.2 |
| 58-221631 | 12/1983 | Japan | 164/160.1 |
| 534291 | 1/1977 | U.S.S.R. | 164/160.2 |
| 1311840 | 5/1987 | U.S.S.R. | 164/160.2 |

*Primary Examiner*—Nicholas P. Godici
*Assistant Examiner*—J. Reed Batten, Jr.
*Attorney, Agent, or Firm*—Cushman, Darby & Cushman

[57] ABSTRACT

A method and device for making moulds shaped on two faces by means of model plates (10,11). After depression of the plates, the envelope (17) sealed at (40) containing the granular material (30) is, in its turn, subjected to depression through the tubes (23) and (24) of the armature. The plates are then removed while the internal depression is maintained. The moulds are juxtaposed, and two adjacents moulds will form a print and their free faces will enable the making of two more with two additional moulds. Thus, (n−1) prints will be obtained for n moulds.

14 Claims, 2 Drawing Sheets

METHOD AND DEVICE FOR FABRICATING MOULDS FROM GRANULAR MATERIAL

Figure 1:
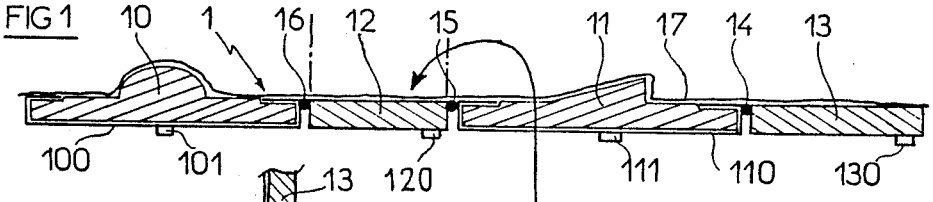

The present invention concerns a device for fabricating foundry moulds from granular material and the method of implementation.

The fabrication of foundry moulds, in particular from siliceous sand by shaping a volume of sand is well known.

A gas-tight sheet such as a plastic film is placed on a form called a model, itself placed on a support allowing thermoforming of the plastic film by suction; above this is placed a frame called "chassis" equipped with air suction devices and filters designed to hold the sand; the volume thus determined is filled with granular material which can be compacted by vibration; above this is placed another plastic film, then, through the chassis, the air caught between the two plastic films in the chassis is drawn out which has the effect of causing cohesion of the grains.

The first half of the print is then made; the same process is used to make the second half and obtain a mould ready for casting. Once casting is completed and after solidification of the cast material, the vacuum is removed. The sand is recycled and the cycle is repeated.

French patent application 2 156 138 describing a device for obtaining molten metal casting moulds can be mentioned to illustrate such a method.

In this case, the chassis consists of two identical parts, one upper and one lower, each including air evacuation tubes connected to a manifold itself connected to a vacuum pump.

The tubes are distributed regularly so as to cover a large surface.

French patent application 2 307 596 concerns a foundry mould chassis in which is provided a means for introducing and recovering the granular material used. This means consists of a volume roughly shaped like a truncated cone, whose small base is provided with a flap through which can be inserted the filling tube. This flap is air-tight and remains closed while the chassis is being used. After moulding, the vacuum is unloaded, with the chassis overturned, the flap opens and allows the material to flow out by gravity.

Such methods and devices allow molding to proceed only at a slow rate since many operations are necessary.

Furthermore, casting is carried out with the mold made by assembling the two chassis, which immobilises two costly chassis to obtain a single mould. Also, it is necessary to perform the shaping operation twice to obtain the upper and lower parts of the mould, as only this double operation leads to obtaining a complete mould. Two separate plastic films are positioned vertically on two model plates which are themselves held vertically.

Mention can also be made of the methods described in German patents DE-A-2.305.229 (SINTOKOGIO) and DE-B-2.407.878 (WAGNER). The armature used in the first method is complex with its double internal wall and the two membranes surrounding it. As the air is drawn only through the lateral faces, the depression is not applied homogeneously to all the granular material, considering the leakage which occurs. The absence of armatures in the second method means that the suction, relatively localised on one or two sides of the block, is very heterogeneous and that handling of such blocks is very delicate.

The present invention concerns a method and device which remedy these drawbacks. The device uses a model plate support, a polymer envelope, an armature with air suction and filtering devices in a known way to retain the granular material which can be connected to a vacuum source. It is characterised by the fact that it includes at least two model plates placed in supports and that the armature has at most three faces.

The device is also remarkable in that the model plate supports are hinged to at least one lower closing plate with a device to supplement the clamping and in that the armature includes two faces interconnected by a device ensuring the rigidity of the assembly and at least part of the air suction and filtering.

The device provides for the use of a preformed envelope.

The process essentially consists of using two model plates to simultaneously make two prints for the same mold and, for this purpose, includes the following steps:

preparation of at least two model plates in supports, installation on the plates of the thermoformed plastic film by suction through the plates, installation of the plates around the armature including at most three faces, filling with the granular material, compacting and leveling, folding down of the upper closing plate(s) for assembly of the two ends of the plastic film, either by simple contact when the depression is created or by gluing or sealing in order to provide a relatively tight envelope around the granular material between the plastic film thus formed on the one hand and the armature end plates on the other hand, sealing of the polymer envelope, establishment of a vacuum in the volume defined by the polymer envelope, removal of the plates, assembly of the blocks obtained to form prints, proceeding as described in German patents DE-B-2.407.878 and DE-A.2.305.229.

The method also provides for the use of preformed polymer envelopes that are positioned between the plates and in which the armature is placed, the following operations being identical.

The invention therefore allows moulds to be obtained with a reduced number of operations.

Only the armature and the consumable polymer envelope are used at the casting station and, as the armature according to the invention is much simpler in design than the existing chassis, the cost and investment are decreased accordingly.

A single operation allows the two faces required for making a casting print to be obtained with a single block; only the ends of the alignment are not used, but the yield is nevertheless improved by nearly 50 percent: $(n-1)$ prints are obtained for n blocks.

The method is semi-continuous, but casting can be made continuous by juxtaposing blocks. The number of parts required is reduced as is the volume of granular material used.

Figure 3:
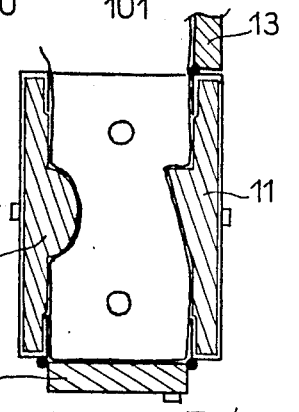
Figure 2:
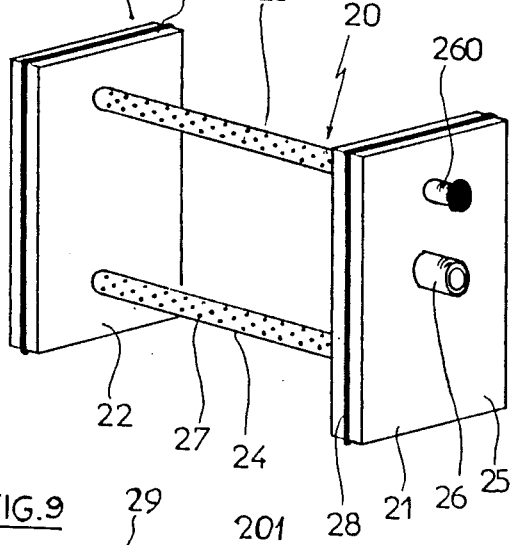
Figure 4:
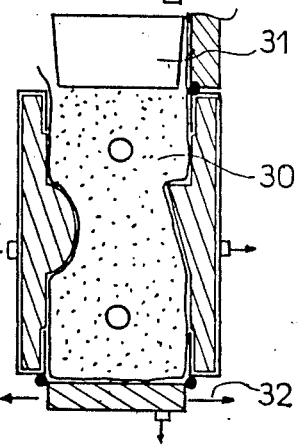
Figure 5:
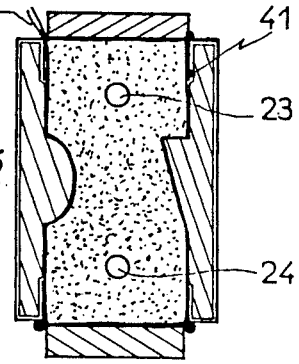
Figure 9:
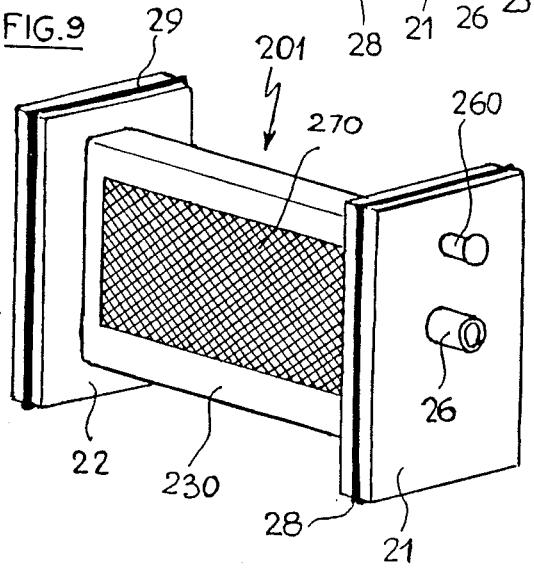
Figure 6:
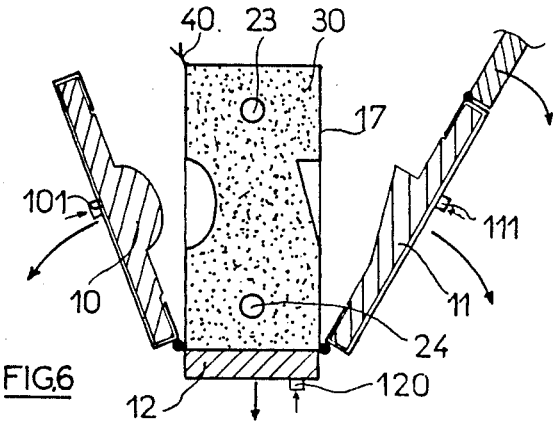
Figure 7:
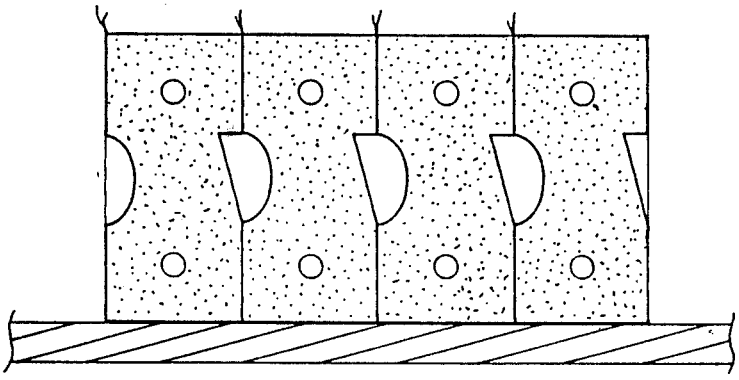
Figure 8:
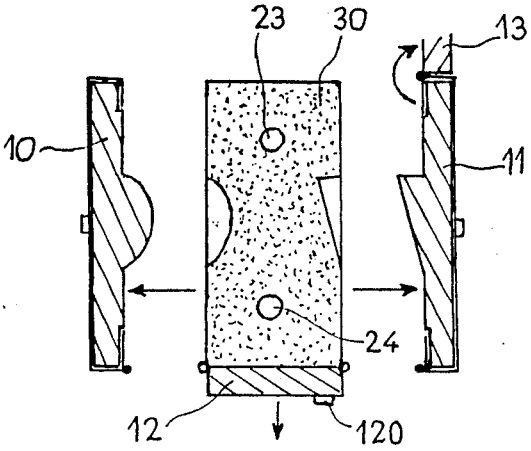

The invention is described below in a particular, nonrestrictive embodiment with reference to the figures in appendix, representing:

FIG. 1: developed hinged support with thermoformed polymer envelope installed,

FIG. 2: armature and assembly on the support represented by the combined line on FIG. 1, FIG. 3: straightening of the hinged support model plates, FIG. 4: filling, compacting, leveling, FIG. 5: folding of the envelope, sealing, closing and depressurisation, FIG. 6: opening of the hinged support to free the block, FIG. 7: juxtaposition of the blocks to form the complete prints, FIG. 8: variant for opening the support by translation, FIG. 9: variant of embodiment of the armature.

FIGS. 1 to 7 are the schematic diagram of fabrication according to the method and with a device according to the invention.

FIG. 1 shows the four plates comprising support 1, two model plates 10 and 11 and two sealing plates 12 and 13. The model plates are placed in housings 100 and 110 in the support so that they can be changed while preserving the basic structure of the support.

These housings are connected to the sealing plates by hinges 14, 15 and 16.

These plates are also each provided with a coupling 101, 120, 111, 130 for connection to a vacuum and/or compressed air source in a known way. The plates are made from perforated panels or are made of porous material to allow suction during thermoforming and future blowing for demoulding.

With the plates placed horizontally, polymer film 17, initially flat, is placed on the surface and adapted to the contour of the model plates by thermoforming under suction.

Plates 10–13 are assembled so that the two model plates are facing each other, with the form on the inside. Sealing plate 12 is used as lower support and is fitted with armature 20. Sealing plate 13 remains open outwards.

Armature 20 consists of two end plates 21, 22 connected by two tubes 23, 24, the end plates being provided with sealing gaskets 28, 29. The tubes are sufficiently thick to make the armature very rigid.

Tubes 23 and 24 open into a volume 25 inside plate 21, forming a common chamber, and external coupling 26 is provided outside this plate.

This coupling can be connected to a vacuum source by any flexible hose.

Handling pins such as 260 are also provided for transportation of the armature.

Tubes 23 and 24 are provided with perforations 27 whose diameter is such that they allow passage of the air but not of the grains of the granular material to be discussed later.

The seal between the armature and the envelope is then ensured by sealing gaskets 28 and 29.

According to a variant of the embodiment of armature 201 (FIG. 9), end plates 21 and 22 are connected by a single duct 230 with a rectangular section whose sides include grated area 270.

FIG. 4 schematically shows filling of the device consisting of the plates, the envelope and armature 20 with siliceous sand 30 of the type used in foundries or any other suitable granular material. Filling is carried out, for instance, by means of a covering block 31 while the device plus sand assembly is subjected to compacting by a vibrating table (not shown) symbolised by arrows 32. Generally, the amplitude and frequency of vibration are adapted to the granular material, and the characteristics and shapes of the model plates.

Simultaneously, a depression is maintained on the surface of the plates by means of a vacuum source and couplings 101, 120, 111, 130, for the purpose of maintaining the polymer envelope perfectly applied to the shapes to be reproduced.

The combined effect of these two actions leads to shaping of sand 30. The upper face is then leveled off.

In FIG. 5, the last part of the polymer envelope is folded over the top of the block with the sealing plate and a seal 40 is made to obtain a closed volume 41.

The assembly can be subjected to compacting by the lower plate and a depression is applied inside closed volume 41 by tubes 23 and 24 connected to a vacuum source by coupling 26.

FIG. 6 shows the removal of the model plates and the sealing plates. This removal is carried out by removing the depression and, if necessary, introducing a slight overpressure to facilitate separation. The removal is carried out by a rotary action as shown in FIG. 6 or by translation as shown in FIG. 8.

The armature 20 and sand 30 assembly in the polymer envelope forms the block which can be transported.

In all cases, the depression must be maintained until solidification to compensate for any leakage, in particular due to damage to the plastic film during casting. The blocks are then juxtaposed to form complete prints as shown in FIG. 7.

The blocks push one another on the casting area after installation of any cores.

Casting is carried out conventionally through the ducts provided, with or without stub ends.

After solidification, the batch is transferred to the stripping station which, by eliminating the depression, allows recovery of the cast part and of the armature and sand.

The sand is recycled whereas the armature is returned to the block fabrication station.

Provision can be made for a continuous process with transfer and feed of blocks one by one.

In this type of mould fabrication, additional clamping can be provided by at least lower face 12 and possibly upper face 11.

For this purpose, a mechanical or a pneumatic device, for instance, is provided on lower closing plate 12 and upper closing plate 11, designed to deform plastic film 17 and compress sand 30. This operation is mainly used for complex shapes.

Similarly, the method according to the invention can be supplemented by known foundry operations.

For instance, the polymer envelope can be covered with a coating of a particular product designed to facilitate stripping.

Similarly, during compacting, the direction of the vibrations can be varied to obtain a better quality of compacting.

As concerns the method and device used to ensure the seal between the armature and envelope, a variant of the invention proposes provision of a peripheral groove on the end plates of the armature placed in relation with the common depressurisation chamber. As concerns the support, it includes an inflatable seal on the corresponding edges.

The method consists of pressing the edge of the polymer envelope into the groove by the inflatable seal before introduction of the sand, carrying out the filling, compacting, leveling, sealing operations then depressurising the sand and the common chamber, which applies the edge of the envelope into the groove; the support and plates can be easily removed.

Similarly, the invention proposes a variant for the production of tubes. The tubes can be hollow with a square or rectangular section. On the lateral faces, a microporous or perforated plate is applied at a certain distance from the surface of the tube in particular by means of running pins. This defines two corridors parallel to the center tube.

Maintenance is thereby facilitated and the filtering plate can be readily replaced; as for the costs, they are reduced because the plate is flat.

Similarly, the method allows use of an armature with three faces with two model plates hinged around a closing plate, two polymer sheets sealed at the upper part after filling and compacting before placing the contents under vacuum.

I claim:

1. A device for making a foundry mould comprising:
- a support having first and second side, model plates and a bottom, sealing plate;
- an armature defining first and second longitudinal end walls of said support, so that said support and said armature together define a mould cavity;
- at least one polymer envelope element disposed within said mould cavity;
- means for feeding a granular material for forming a foundry mould into said mould cavity; and
- means for generating a vacuum within said mould cavity.

2. A device as in claim 1, further comprising a top, sealing plate for sealing said mould cavity from above.

3. A device as in claim 1, wherein each said side, model plate is hingedly coupled to said bottom, sealing plate.

4. A device as in claim 3, wherein said top, sealing plate is hingedly coupled to one of said side, model plates.

5. A device as in claim 1, wherein said armature comprises first and second end plates interconnected by at least one tubular member for evacuating air from said mould cavity.

6. A device as in claim 1, wherein said polymer envelope element has an area corresponding to an area of at least said bottom sealing plate and said side, model plates.

7. A device as in claim 1, wherein said support includes first and second housings for receiving said side, model plates.

8. A device as in claim 1, wherein a sealing element is defined about a peripheral edge of each of said end plates so as to ensure a seal between each said end plate and said envelope element.

9. A method of making a foundry mould comprising:
- provided a support including first and second side, model plates and a bottom, sealing plate;
- installing on said side and bottom plates at least one polymer envelope by thermoforming by suction through said plates;
- providing an armature including first and second end plates;
- mounting said side and bottom plates in surrounding relation to said end plates of said armature so as to define a mould cavity having side walls, end walls and a bottom wall, said polymer envelope being clamped between the end plates of the armature and the side and bottom plate;
- filling the mould cavity with granular material for forming said foundry mould, compacting said granular material and leveling the same;
- sealing said mould cavity;
- placing the volume contained in the polymer envelope within the mould cavity under vacuum; and
- removing said plates.

10. A method as in claim 9, wherein said step of providing a support comprises providing a support including plates mounted in housings.

11. A method as in claim 9, wherein said step of providing a support comprises providing a support which further includes a top sealing plate.

12. A method as in claim 9, further comprising sealing said polymer envelope above the granular material for forming the foundry mould prior to said step of applying a vacuum.

13. A method as in claim 9, wherein said step of providing a support comprises providing a support wherein said side, model plates are hingedly mounted to said bottom, sealing plate.

14. A method as in claim 9, further comprising providing seals on the support so as to provide a seal between the envelope and armature prior to the addition of the granular material for forming the foundry mould.

* * * * *